US005727481A

United States Patent [19]

Voorhees et al.

[11] Patent Number: 5,727,481

[45] Date of Patent: Mar. 17, 1998

[54] PORTABLE ARMORED INCINERATOR FOR DANGEROUS SUBSTANCES

[76] Inventors: Randall Paul Voorhees, R.R. #1, Box 427, Falls, Pa. 18615; Joseph Ernest Voorhees, P.O. Box 84, Lake Winola, Pa. 18625

[21] Appl. No.: 504,780

[22] Filed: Jul. 20, 1995

[51] Int. Cl.[6] ..... F23G 7/00

[52] U.S. Cl. ..... 110/237; 110/241; 110/212; 110/193

[58] Field of Search ..... 110/193, 233, 110/212, 237, 240, 346, 241

[56] References Cited

U.S. PATENT DOCUMENTS

| | | | |
|---|---|---|---|
| 2,985,120 | 5/1961 | Brandt et al. . | |
| 3,307,507 | 3/1967 | Boyd et al. | 110/193 |
| 3,785,303 | 1/1974 | Hopkins | 110/240 X |
| 3,882,800 | 5/1975 | du Chambon . | |
| 3,938,450 | 2/1976 | Jaronko et al. . | |
| 4,627,365 | 12/1986 | Tseng . | |
| 4,688,494 | 8/1987 | Domnitch | 110/240 |
| 4,852,815 | 8/1989 | Giannotti . | |
| 5,237,938 | 8/1993 | Fujimori et al. . | |
| 5,495,812 | 3/1996 | Schulze | 110/237 |

*Primary Examiner*—Henry A. Bennett
*Assistant Examiner*—Susanne C. Tinker
*Attorney, Agent, or Firm*—Richard C. Litman

[57] ABSTRACT

A mobile incinerator suitable for burning explosive material, has armored walls capable of withstanding internal explosions, a primary combustion chamber within which initial burning of the material to be incinerated takes place, a secondary combustion chamber to burn exhaust from the primary combustion chamber a second time to reduce pollution and safety hazards, and a trailer for providing transportation. The armored walls may include steel plates reinforced by steel channel beams. The mobile incinerator includes: vents for allowing air and exhaust to pass into; between and out of the combustion chambers, assisted by a draft induction fan, with flammable fluid delivered to and ignited within the combustion chambers; pressure release hatches; a loading cart mounted on telescoping rails by which material to be incinerated can be inserted through an opening; refractory material lining the primary combustion chamber; an exterior shell of aluminum sheeting; and a control system powered by a generator. The trailer is preferably equipped with hydraulic brakes, a surge brake actuator, and a leveling device.

9 Claims, 6 Drawing Sheets

PORTABLE ARMORED INCINERATOR FOR DANGEROUS SUBSTANCES

BACKGROUND OF THE INVENTION

1. FIELD OF THE INVENTION

The present invention relates to incinerators designed for the incineration of explosive articles, such as ammunition, fireworks, and other dangerous substances.

2. DESCRIPTION OF THE PRIOR ART

There presently is a need, in particular for law enforcement agencies, for disposal of materials such as seized ammunition, fireworks, and illegal drugs, that is better than the current method of digging a pit, placing the contraband in the pit, pouring gasoline or other flammable liquid over it, and setting it afire, with the resultant pollution and hazards to bystanders, including noxious fumes, and personal injury and property damage from explosions and sudden flames. Though it is not believed that the present invention is suitable for high explosives, current bomb disposal devices do not provide an apparatus by which moderately explosive materials, such as small ammunition or pyrotechnics, can be completely incinerated. Mobile incinerators in the prior art are not armored to protect against explosions. When explosive material must be transported to a site where it can be safely disposed of, besides the hazards of transport, there are the costs and delays necessary to obtain government permits.

U.S. Pat. No. 2,985,120, issued on May 23, 1961, to John B. Brandt et al., discloses a mobile incinerator designed to burn garbage and refuse, which has primary and secondary combustion chambers. It is not armored, nor does it have explosion hatches, as the instant invention does in the preferred embodiment, to withstand shocks from explosions, and uses a conveyor belt to load material to be incinerated.

U.S. Pat. No. 3,882,800, issued on May 13, 1975, to Michel G. J. du Chambon, discloses an automotive unit for the collection and incineration of household or industrial refuse, with a rotary furnace. It is not armored and has no explosion hatches, and material to be burned is carried into the furnace by an endless screw.

U.S. Pat. No. 3,938,450, issued on Feb. 17, 1976, to John C. Jaronko and John T. Jaronko, discloses an apparatus for collecting and disposing of refuse, having a wheeled chassis carrying a hopper, shredder and fan for directing air and refuse to a cylindrical member where the refuse is burned.

U.S. Pat. No. 4,627,365, issued on Dec. 9, 1986, to Kuoy-uan Tseng, discloses a mobile garbage incinerator, with a hanging drum for lifting and dumping garbage into a collecting tank, from which the garbage is moved to a main incinerating room, and then to a secondary incinerating room.

U.S. Pat. No. 4,852,815, issued on Aug. 1, 1989, to Hugo V. Giannotti, discloses an in transit resource recovery system, including a motor vehicle on which are mounted means for bag-ripping, sorting, shredding, pre-heating and pre-volatilization, classifying, incineration, and gas clean-up, and containing bins for collecting recyclable items and ash.

U.S. Pat. No. 5,237,938, issued on Aug. 24, 1993, to Minoru Fujimori et al., discloses a mobile type medical refuse incinerating vehicle, having a main furnace and an after burning furnace, with means for injecting lime water into the main furnace.

None of the aforementioned prior inventions are armored, have explosion hatches, or a loading cart mounted on telescoping rails.

While there are mobile incinerators in the prior art, none are comparable to the instant invention in their ability to safely and completely incinerate explosive materials. The prior art does not teach the present combination, which includes armor to withstand explosions in the material being incinerated, primary and secondary combustion chambers to insure complete burning, and in the preferred embodiment, pressure release hatches and a loading cart on telescoping rails for inserting materials to be incinerated.

None of the above inventions and patents, taken either singly or in combination, is seen to describe the instant invention as claimed.

SUMMARY OF THE INVENTION

The mobile incinerator of the instant invention is suitable for burning explosive material, having armored walls capable of withstanding internal explosions, a primary combustion chamber within which initial burning of the material to be incinerated takes place, a secondary combustion chamber to burn exhaust from the primary combustion chamber a second time to reduce pollution and safety hazards, and a trailer or other means for providing transportation. The armored walls may include steel plates reinforced by steel channel beams. The armor plating protects against damage both to persons and property, and to the mobile incinerator itself.

In the preferred embodiment, there are: vents for allowing air and exhaust to pass into, between and out of the combustion chambers, assisted by a draft induction fan, with flammable fluid delivered to and ignited within the combustion chambers; pressure release hatches; a loading cart mounted on telescoping rails by which material to be incinerated can be inserted through an opening; refractory material lining the primary combustion chamber; an exterior shell of aluminum sheeting; and a control system powered by a generator. The trailer is preferably equipped with hydraulic brakes, a surge brake actuator, and a leveling device.

This invention eliminates the need for hazardous transportation of explosive substances that are to be destroyed, as the invention can easily be brought to the site where they are located. The present invention will also eliminate the need for costly permits required for the moving of such material, or make it safer and easier to transport explosive substances for incineration in a different location. With easy set-up and uncomplicated operation, the invention will reduce labor and other disposal costs, and minimize disposal time. It will eliminate exposure to open flames, possible injury through explosion, and reduce exposure to toxic fumes. The primary and secondary combustion chambers minimize pollution from the incineration by ensuring that there are no unburned combustible airborne particles or vapors emitted. The loading cart on telescoping rails allows for easy loading and removal of waste with its telescoping design, and allows for the safe disposal of ash and debris after incineration.

Accordingly, it is a principal object of the invention to provide a safe and effective means for law enforcement officials or other persons to dispose of explosive materials including ammunition and fireworks, or other contraband including illegal drugs.

It is another object of the invention to provide an incinerator that can withstand the internal shocks resulting from burning explosive articles and substances.

It is a further object of the invention to provide a means for insuring that substances that would be harmful to inhale in an unburned state are completely combusted.

Still another object of the invention is to provide a safe and effective means for disposing of explosives or other hazardous materials that can easily be brought to the site where it is needed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

Broken lines show parts of the invention hidden from view.

DETAILED DESCRIPTION OF THE PREFERRED EMBODIMENT

Figure 1:
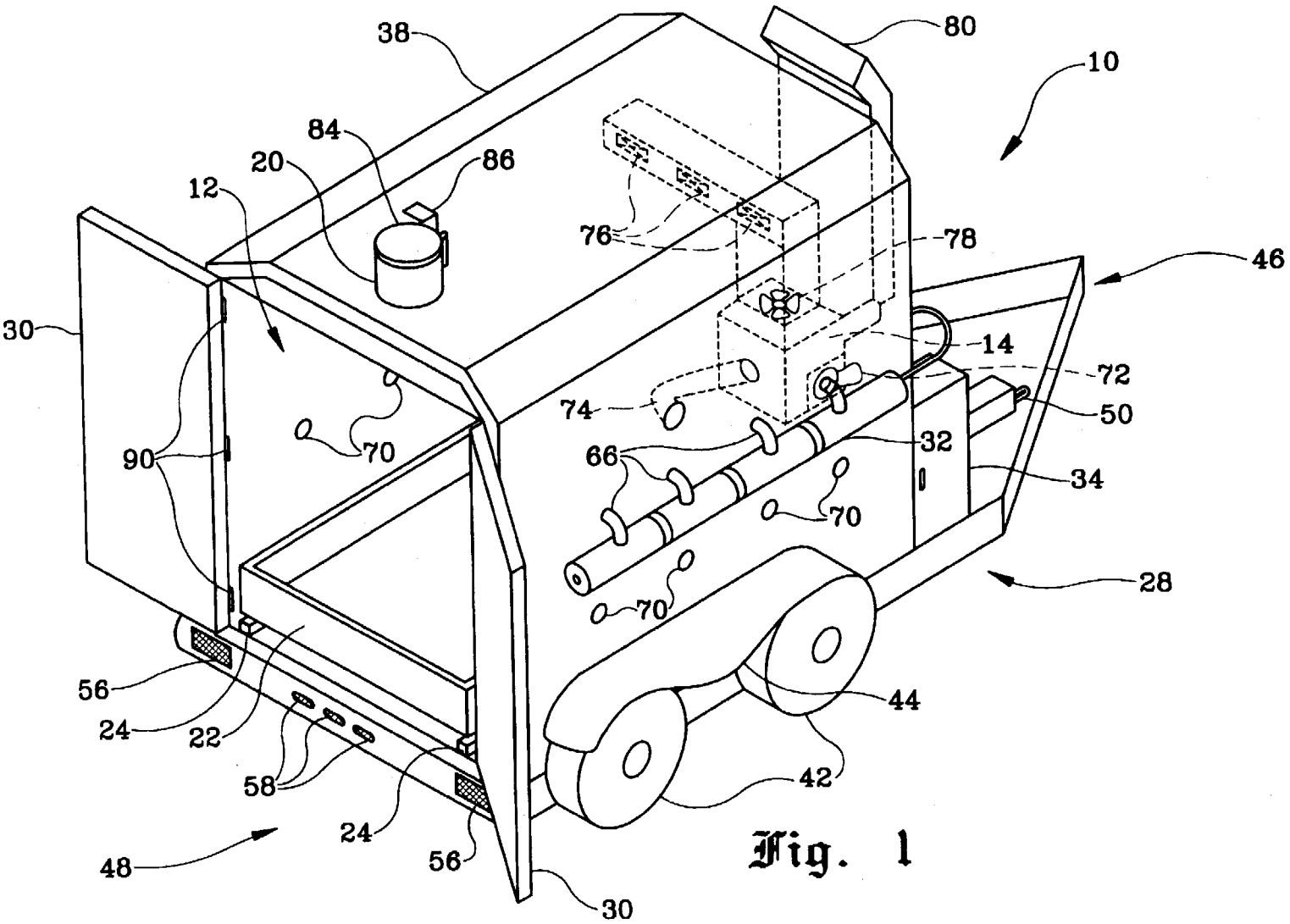
FIG. 1 is a rear perspective view of the invention, with one of the two pressure release hatches omitted to show other features more clearly.

Referring to FIG. 1, the present invention is an armored mobile incinerator 10, including, in a preferred embodiment: a primary combustion chamber 12; a secondary combustion chamber 14; armor plating 16 reinforced by beams 18 (see FIGS. 3 and 4); pressure release hatches 20; a loading cart 22 mounted on telescoping rails 24 and 26 (see FIG. 2); a trailer 28; doors 30; gas trains 32; a control panel 34 and a generator 36 (see FIGS. 4 and 5); and an outer aluminum shell 38.

Figure 5:
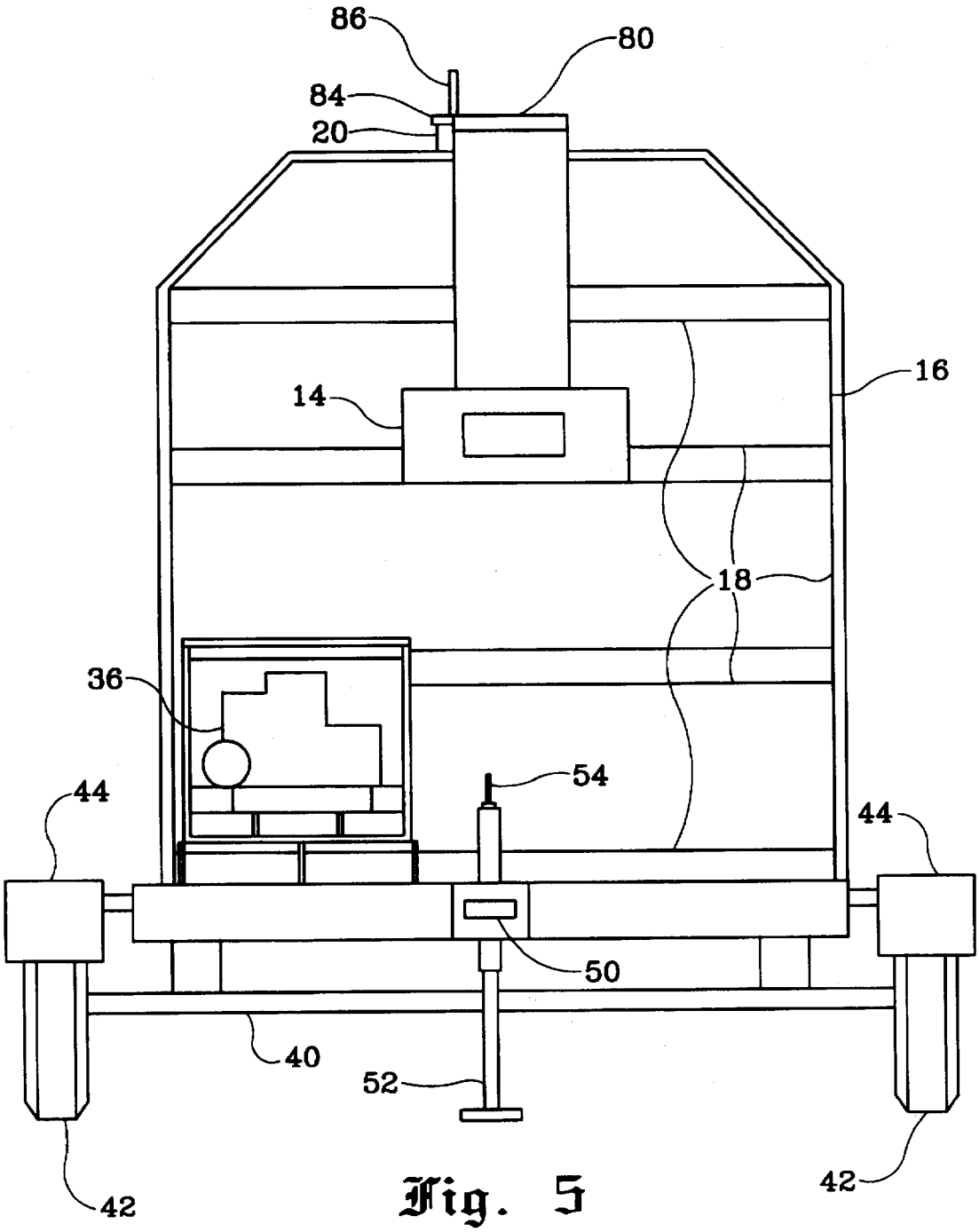
FIG. 5 is a front, elevational view of the invention, showing interior detail.
Figure 6:
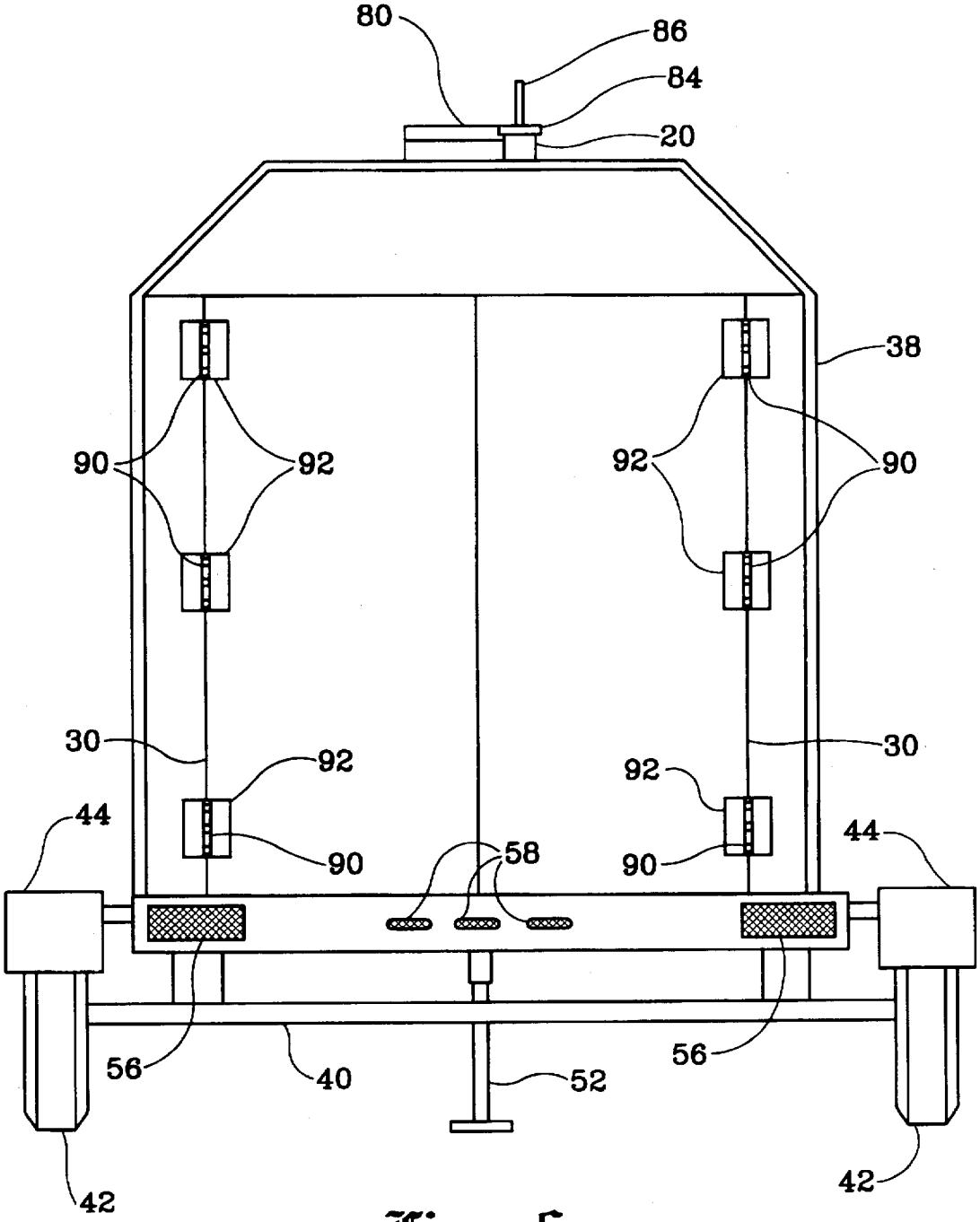
FIG. 6 is a rear elevational view of the invention.

While the incinerator is mounted on a trailer 28 in the preferred embodiment, mobility could be otherwise provided such as making the incinerator an integral part of a motor vehicle, or attaching it to a sled or boat. The frame of the trailer 28 is constructed using channel beams and cross members, reinforced by triangular gussets (not shown). In the preferred embodiment, the channel beams are constructed of steel and are eight inches by eight inches in cross section, and weigh 13.75 pounds per foot. The cross members are preferably steel channel beams four inches by four inches in cross section. The frame is coped to fit the parts of the mobile incinerator 10 resting upon it, and solidly welded to ensure strength for both highway and off-road travel. Referring to FIGS. 5 and 6, the trailer has dual axles 40, each being rated for carrying a load of at least 4,000 pounds, preferably. Hydraulic brakes (not shown) are provided for each of the four wheels 42, and protective fender skirts 44 are provided as well.

Figure 3:
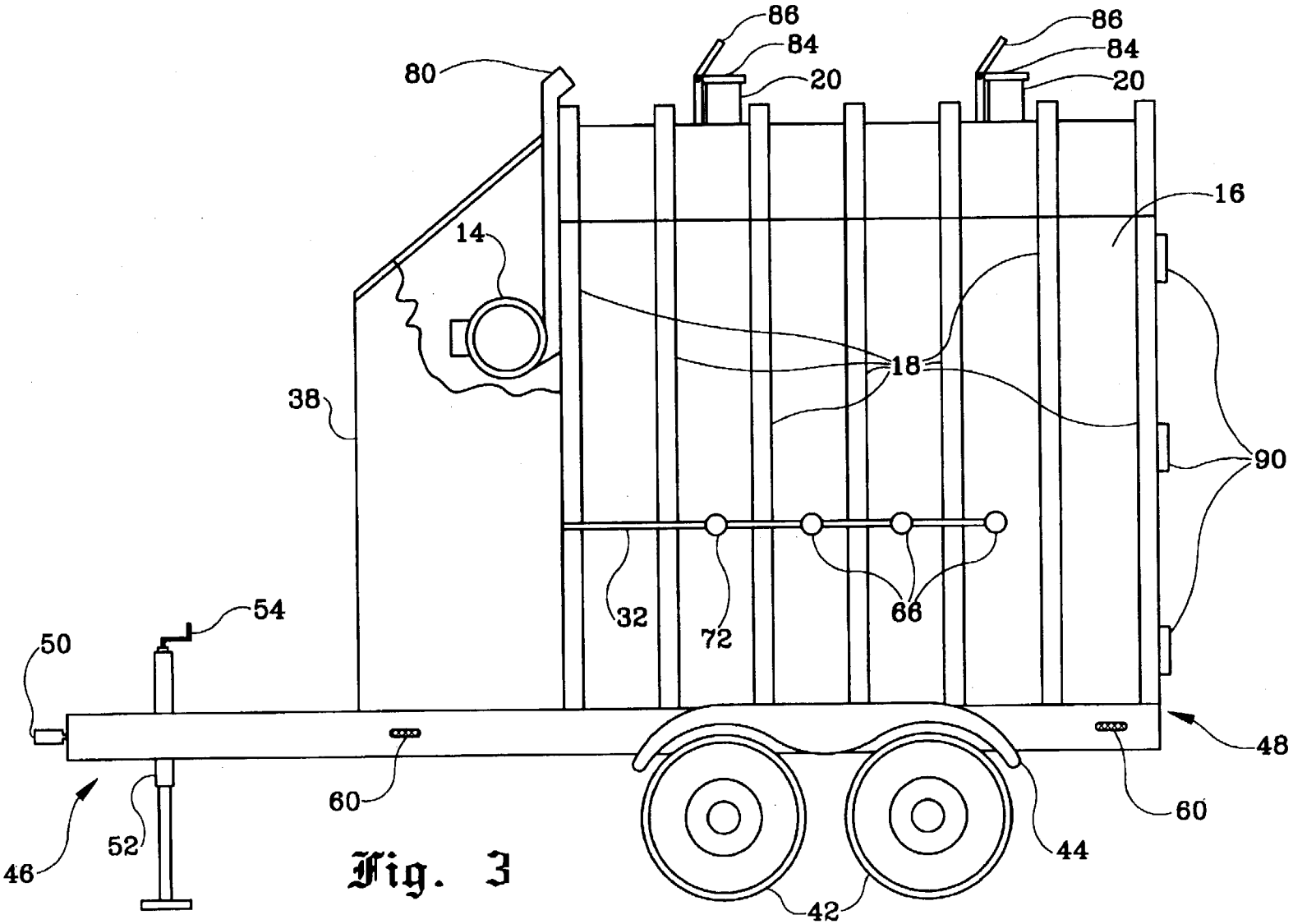
FIG. 3 is a left side, elevational view of the invention, with a portion of an aluminum cover cut away to reveal the secondary combustion chamber and further showing an interior side wall of the primary combustion chamber, exposed to reveal interior steel reinforcing beams.
Figure 4:
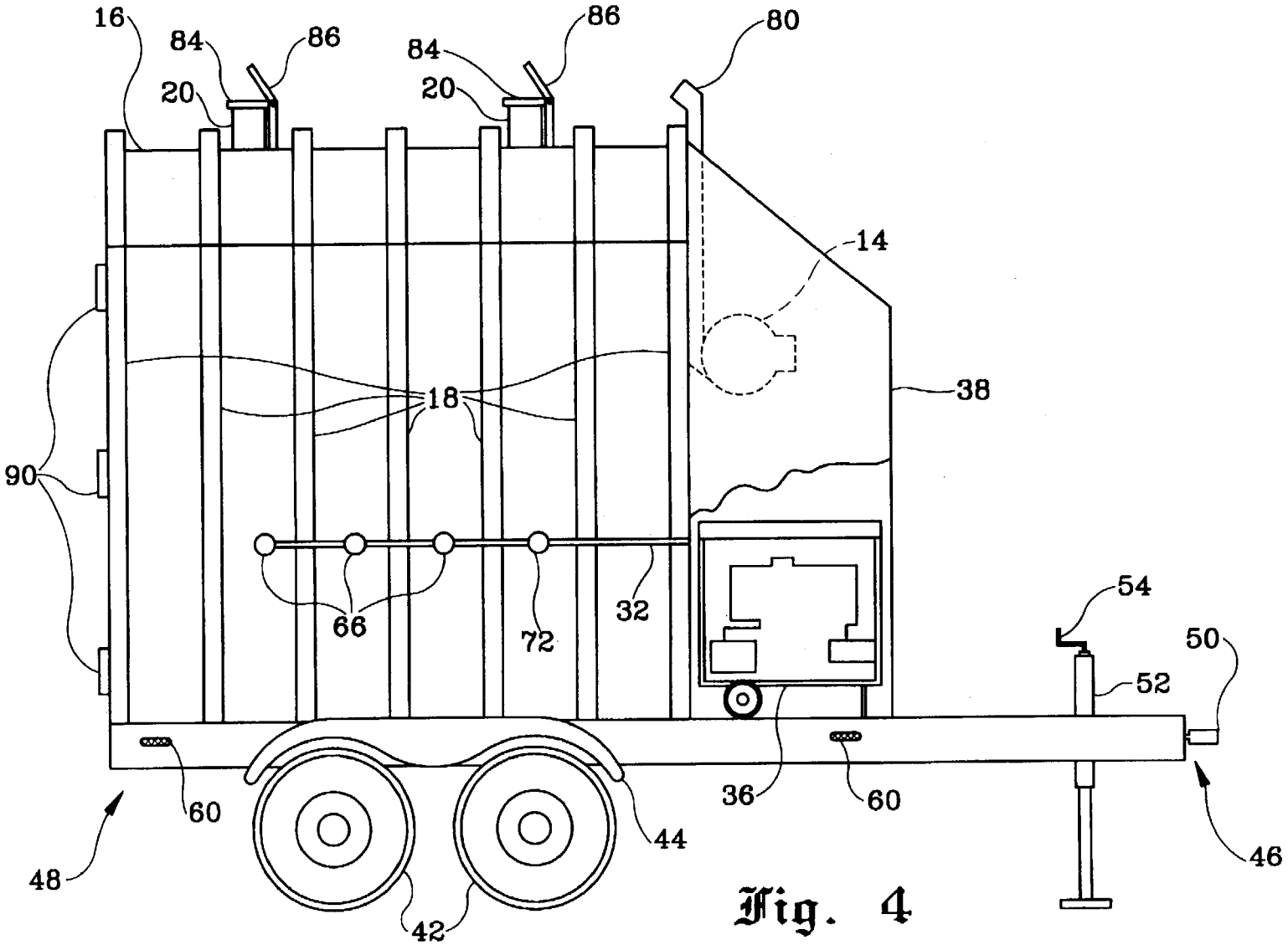
FIG. 4 is a right side elevational view of the invention, similar to FIG. 3, but with a portion of the secondary combustion chamber aluminum cover cut away to reveal the generator.

Referring to FIGS. 3 and 4, the trailer 28 includes a front end 46, by which it is attached to the towing vehicle, and a rear end 48. It is equipped with a surge brake actuator on the front end, preferably able to exert a pressure of 20,000 pounds, for smoother and more responsive braking with heavy loads. The surge brake actuator includes a cylindrical piston 50 attached to the vehicle pulling the trailer, which, when the trailer moves closer to the vehicle, as when the vehicle is slowing down or moving down an incline, is pushed inward, thereby increasing hydraulic pressure on the brakes. When the trailer moves away from the pulling vehicle, as when the vehicle is accelerating or moving up an incline, the cylindrical piston is pulled outward, thereby decreasing hydraulic pressure and releasing the brakes. There is also a leveler 52, by which the end of the trailer near the vehicle may be raised or lowered by manually turning a crank 54. The trailer lighting and signalling devices 56, 58 (see FIG. 1) and 60 are wired for twelve volts, powered by the battery or generator of the vehicle pulling the trailer, and meet the requirements of U.S. Department of Transportation regulations.

Referring to FIGS. 3 and 4, the primary combustion chamber is fabricated from armor plate 16, surrounded with beams 18 for added support and to eliminate warpage. In a preferred embodiment, the armor plate is fabricated of steel and is at least three-eights of an inch thick. The beams are preferably steel channel beams, three inches by three inches in cross section, weighing 4.1 pounds per foot, and parallel with their centers spaced 16 inches apart. The primary combustion chamber is preferably eight feet six inches long, five feet four inches wide, and six feet high. Preferably, all weld joints in the primary combustion chamber are bevelled at 45 degrees, and use full penetration welds. Full penetration means that when two pieces of metal are welded together, one piece passes through a fitted hole in the other piece, which creates a much stronger bond. Inside the primary combustion center, on all 90 degree corners, steel gussets (not shown) are installed at 45 degree angles, using continuous welding. This reduces pressure on the corners, adding strength and eliminating warpage from heat.

Referring to FIG. 1, the primary burners 66 are gas units which run on a supply of liquid propane, supplied through gas trains 32. In the preferred embodiment there are eight primary burners, and electrically operated regulators (not shown) which coordinate and control burn cycles, times and temperature. There are also intake vents 70 to allow ambient air to pass into the primary combustion chamber.

The primary combustion chamber is preferably lined on the inside with boiler refractory (not shown), to absorb heat, and avoid overheating the metal, which would cause metal fatigue. In a preferred embodiment, the refractory is a mixture of quartz-cristobalite, fused silica, amphorous silica, zirconium silicate, and graphite.

Referring to FIG. 1, the secondary combustion chamber 14 in a preferred embodiment is fabricated from 11 gauge steel plate. The secondary burner 72 also preferably uses liquid propane, and it is designed to burn all exhaust from the primary combustion chamber a second time, thereby ensuring that all combustible particles and gasses in the exhaust have been burned, which reduces pollution to safe levels. In the preferred embodiment, there is an intake valve 74 to allow ambient air to pass into the secondary combustion chamber.

Ordinary spark plugs (not shown) can be used to ignite each primary burner and the secondary burner. The heat in each chamber can be adjusted to a temperature suitable for the material being incinerated. Normally, the temperature in the secondary combustion chamber should be higher that the in the primary combustion chamber, to insure complete burning of any combustible airborne particles or vapors that are not completely burned in the primary combustion chamber. There are transfer vents 76 to allow exhaust to pass from the primary combustion chamber to the secondary combustion chamber. There is a draft induction fan 78 to assist movement of ambient air and exhaust through the intake vents 70 and 74 and exhaust through the transfer vents 76 and the exhaust vent 80.

Referring to FIGS. 4 and 5, the generator 36 is gasoline powered, preferably provides 120 or 240 volts, and it powers all electrical components and functions, including controls, burners 66 and 72, the control panel 34 (see FIG. 1), and lighting, except for the previously mentioned trailer lighting and signalling devices 56 and 58 (see FIGS. 1, 3 and 4) powered by the vehicle when the trailer is being towed. The lighting includes safety lighting and marker lights as required by U.S. Department of Transportation regulations.

Covering the primary and secondary combustion chambers, gas trains, and generator, in the preferred embodiment, is a 14 gauge aluminum shell 38. This shell composes the outer skin of the unit and allows the outside to remain at safe temperature levels and cool to the touch during operation.

The two pressure release hatches 20 (see FIGS. 2, 3 and 4) are located on top of the unit. The hatches are needed in case of a pressure build-up during the combustion process, when they will open, relieve the pressure, and automatically reset. In the preferred embodiment, the hatches may be made of eight inch diameter, schedule 40 black steel pipe. The top 84 of each hatch is preferably constructed from steel plate, one quarter inch thick, and is hinged for quick opening. There are stops 86 that limit the movement of the tops.

Figure 2:
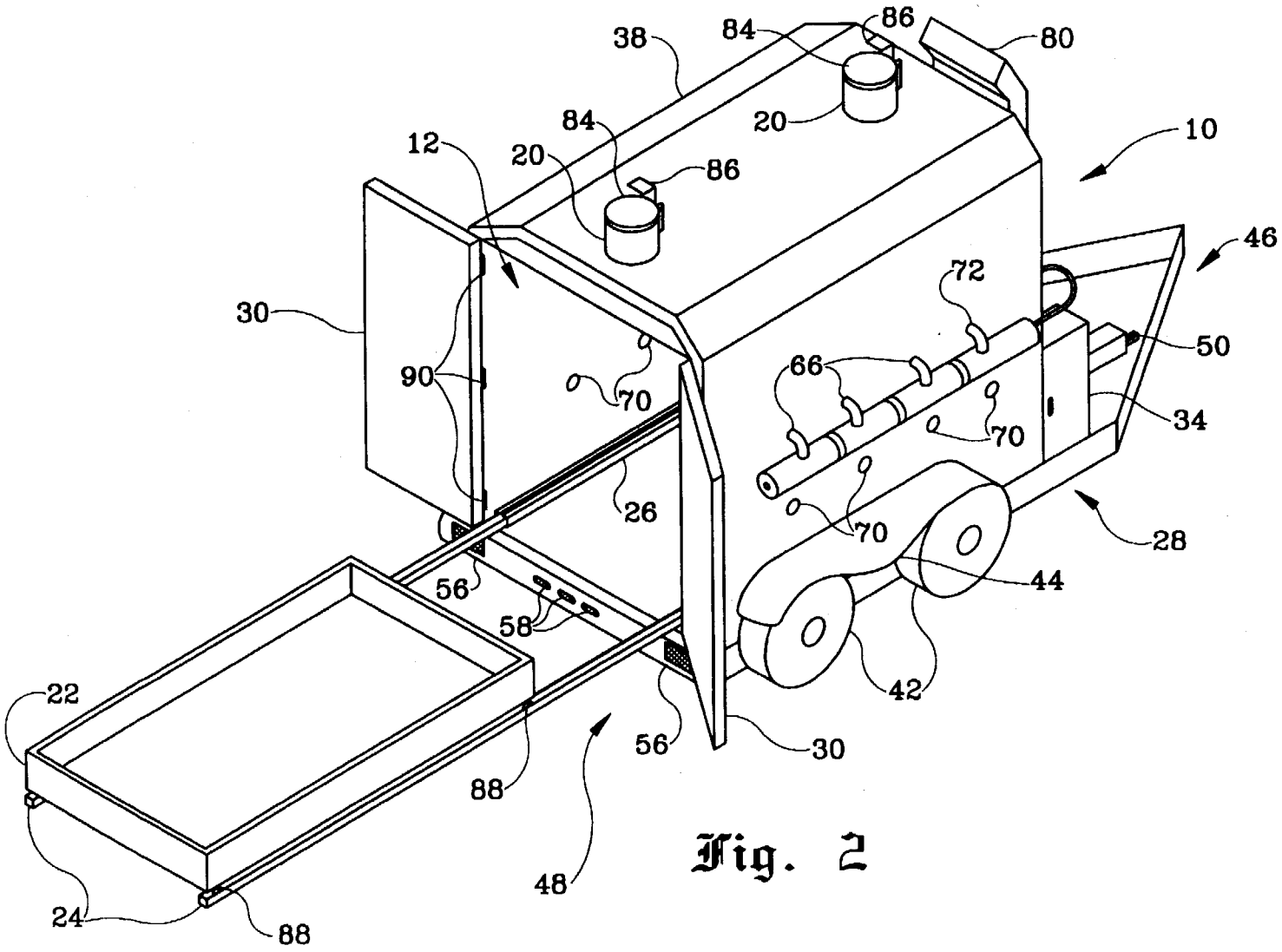
FIG. 2 is a rear perspective view of the invention, showing the loading cart in an extended position.

Referring to FIGS. 1 and 2, the loading cart 22 is mounted on telescoping rails 24 and 26 and pulls outward from the back of the unit. When the telescoping rails are in an extended position (as in FIG. 2), the smaller inside portion of each rail 24 extends beyond the larger outside portion 26. In a preferred embodiment, it may extend eight feet out from the unit's doors. This allows for easy loading of items to be incinerated, and for easy removal of ashes and debris after incineration. The cart itself is preferably constructed of square tubing, 1.5 inches by 1.5 inches in cross section with a wall thickness of 0.25 inches, welded solid for strength. The cart is removable, and rolls on guide rails with raised sides, preferably three inches wide, with trolley wheels 88. The cart can be loaded manually or with a lift truck.

Referring to FIG. 6, the doors 30 are on the rear of the mobile incinerator, and open outward on hinges 90 having vertical axes. The frames of the doors are preferably fabricated from square tubing, and covered with inside and outside skins made of steel plate. All door joints are continuously welded. There are three hinges on each of the two doors, with latches 92 on the exterior. In a preferred embodiment, the doors are each 26 inches wide, 60.5 inches high, and 2.75 inches thick, their inside skin is ⅜ inches thick, their outside skin is ¼ inches thick, and the square tubing has a cross section of two inches by two inches with a thickness of one quarter inch.

It is to be understood that the present invention is not limited to the sole embodiment described above, but encompasses any and all embodiments within the scope of the following claims.

We claim:

1. A mobile incinerator for burning explosive materials comprising:

a primary combustion chamber having armored walls constructed of steel plates and steel channel beams attached to said steel plates, said primary combustion chamber being lined with a refractory material;

a secondary combustion chamber communicating with said primary combustion chamber;

a loading cart mounted onto telescoping rails and removably positioned within said primary combustion chamber to allow loading of material to be incinerated;

a hatch communicating with each said chamber for releasing pressure; and means for transporting said mobile incinerator.

2. The mobile incinerator according to claim 1, further comprising an intake vent to allow ambient air to pass into said primary combustion chamber and said secondary combustion chamber, a transfer vent through which exhaust passes from said primary combustion chamber to said secondary combustion chamber, and an exhaust vent through which exhaust exits from said secondary combustion chamber.

3. The mobile incinerator according to claim 2, further comprising a draft induction fan to assist movement of ambient air and exhaust through said intake vent, said transfer vent, and said exhaust vent.

4. The mobile incinerator according to claim 2, further comprising a means for delivering flammable fluid to said primary combustion chamber and said secondary combustion chamber, and means for igniting said flammable fluid in said primary combustion chamber and said secondary combustion chamber.

5. The mobile incinerator according to claim 1, wherein said mobile incinerator includes an exterior shell of aluminum sheeting.

6. The mobile incinerator according to claim 1, further including a control system to control combustion within each said chamber and a generator to supply power to said control system.

7. The mobile incinerator according to claim 1, wherein said means for moving said mobile incinerator is a trailer, said mobile incinerator being mounted onto said trailer.

8. The mobile incinerator according to claim 7, wherein said trailer includes wheels equipped with hydraulic brakes and a surge brake actuator.

9. The mobile incinerator according to claim 7, wherein said trailer includes a leveling device for raising and lowering an end of said trailer.

* * * * *